United States Patent [19]

Kunkle

[11] 4,037,727

[45] July 26, 1977

[54] ADJUSTABLE PAINTING OR PLATING RACK

[75] Inventor: Kenneth W. Kunkle, Grand Rapids, Mich.

[73] Assignee: Pierce America, Inc., Grand Rapids, Mich.

[21] Appl. No.: 645,951

[22] Filed: Jan. 2, 1976

[51] Int. Cl.[2] ..... A47F 5/08; C25D 17/04

[52] U.S. Cl. ..... 211/117; 204/297 W

[58] Field of Search ..... 211/113–119, 211/175, 207, 208; 269/46; 204/297 R, 297 W; 118/428, 500, 502, 503

[56] References Cited

U.S. PATENT DOCUMENTS

| | | | |
|---|---|---|---|
| 811,375 | 1/1906 | Clark | 204/297 W |
| 2,734,859 | 2/1956 | Reilly et al. | 204/297 W |
| 2,858,265 | 10/1958 | Schneider | 204/297 |
| 2,858,266 | 10/1958 | Schneider | 204/297 W |
| 2,957,590 | 10/1960 | Armiger | 211/117 X |
| 3,029,952 | 4/1962 | Bagdon et al. | 211/117 |
| 3,129,820 | 4/1964 | Stulman | 211/117 |

*Primary Examiner*—Roy D. Frazier
*Assistant Examiner*—Terrell P. Lewis, Jr.
*Attorney, Agent, or Firm*—McGarry & Waters

[57] ABSTRACT

An adjustable rack for hanging objects to be painted or plated having a hanging vertical support column with a plurality of adjustable arms connected to the vertical support column. Each arm has a plurality of vertical suspended hooks which can be easily adjusted or removed as desired.

9 Claims, 11 Drawing Figures

ADJUSTABLE PAINTING OR PLATING RACK

BACKGROUND OF THE INVENTION

1. Field of the Invention

This invention relates to plating or paint racks. In one of its aspects, the invention relates to an adjustable rack from which can be adjusted to accommodate different types of articles.

2. Description of the Prior Art

Racks to hang work in the process of painting or plating are conventionally welded together and non-adjustable. It was consequently necessary to have a variety of differently sized racks when a variety of differently sized work were to be plated.

Adjustable work hangers previously known are disclosed in the U.S. Pat. to Bagdon et al, No. 3,029,952, issued Apr. 17, 1962. The Bagdon reference discloses a work hanger which has key holes throughout the length of the hanger. Cross arms are attached to the rack by use of lugs fitting through and interconnecting with the narrow portion of the key hole. S-hooks may be located on the notches on the cross arm or through the apertures in the cross arm.

SUMMARY OF THE INVENTION

According to the invention, an apparatus is provided for the suspension of a plurality of articles so that they may be painted or plated while being free of any unnecessary obstructing contact with other objects. The invention comprises a vertical support shaft suspended from an appropriate hanger. At least one horizontal arm is removably and adjustably attached to the vertical shaft. A plurality of hoods are removably and adjustably attached to each horizontal arm.

The horizontal arm of the invention is fixedly attached to the vertical shaft by fasteners which are releasable, thereby allowing the horizontal arm to be fixedly attached at a choice of different vertical points along the vertical shaft. Each horizontal arm may be released and not reattached when the horizontal arm is not desirable.

The plurality of hooks are releasably and adjustably attached to the horizontal arm by means of fasteners. Preferably, the horizontal arm is C-shaped with a plurality of slots in its bottom section and extending the length of the horizontal arm to allow the hooks to be placed therethrough. The hook has a top section which abuts the front section of and interconnects with the horizontal arm. The fasteners include an inner channel member having apertures therethrough. The inner channel member is along the open section of the C-shaped horizontal arm. The apertures of the inner channel member align with apertures through the horizontal arm and threaded fasteners are inserted therethrough to hold the inner channel member and the plurality of hooks in a fixed position with respect to the horizontal arm.

The adjustability of the horizontal arms in a vertical direction and the adjustability of the hooks in a horizontal direction provides versatility in placing a plurality of hooks where desirable to allow the rack to be used successively to hang differently shaped items.

BRIEF DESCRIPTION OF THE DRAWINGS

The invention will now be described with reference to the accompanying drawings in which.

DETAILED DESCRIPTION OF THE PREFERRED EMBODIMENTS

Figure 1:
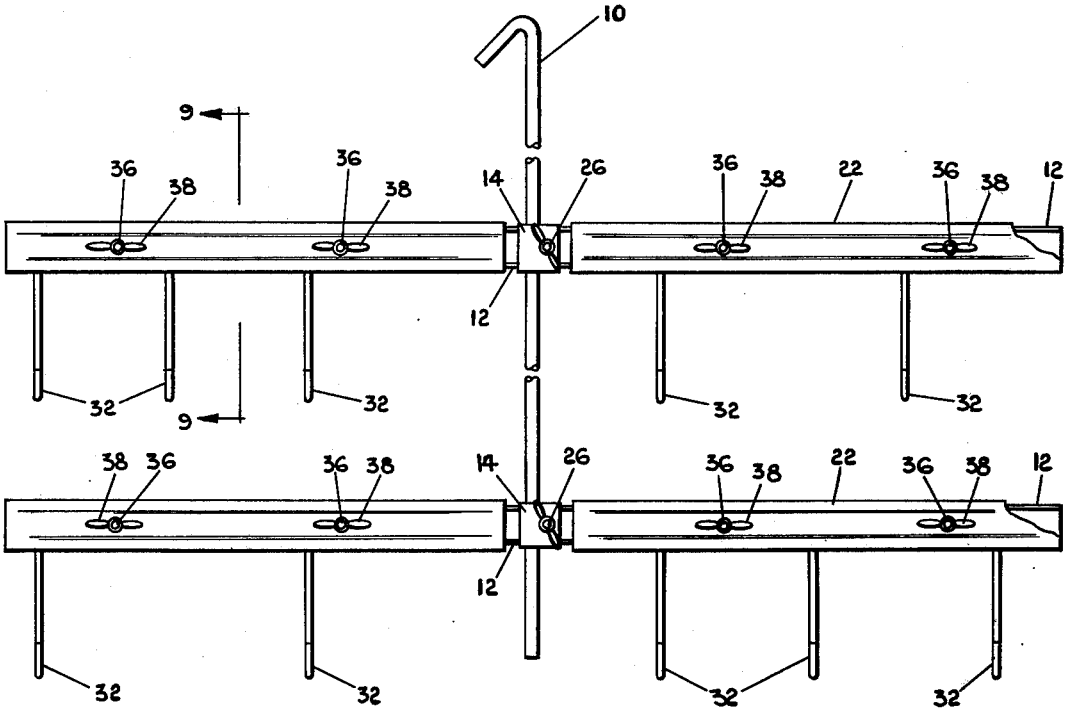
FIG. 1 is a partially broken front elevational view of the apparatus according to the invention.
Figure 2:
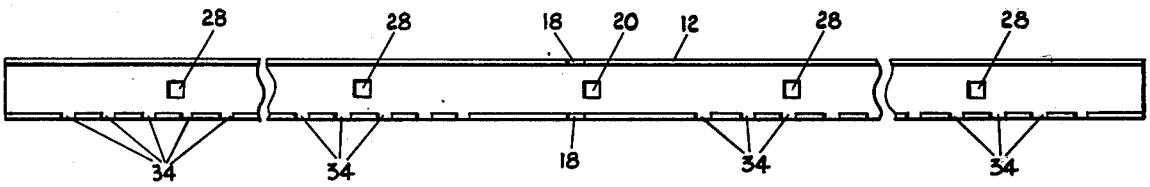
FIG. 2 is a front elevational view of the horizontal arm according to the invention.
Figure 3:
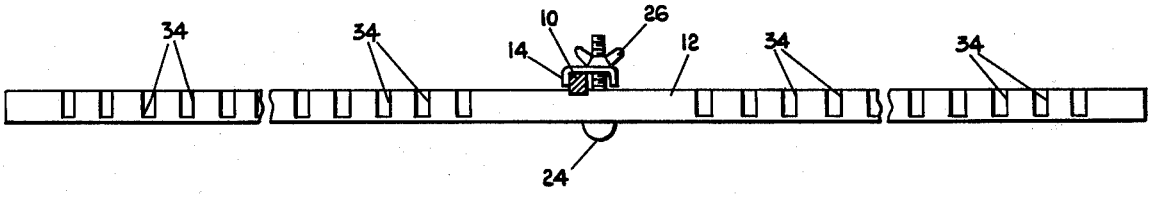
FIG. 3 is a bottom view of the invention showing the fastening means between the vertical shaft and the horizontal arm.
Figure 4:
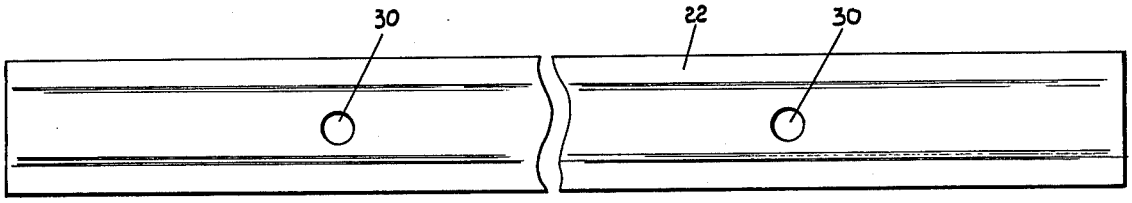
FIG. 4 is a front elevational view of the inner channel member according to the invention.
Figure 9:
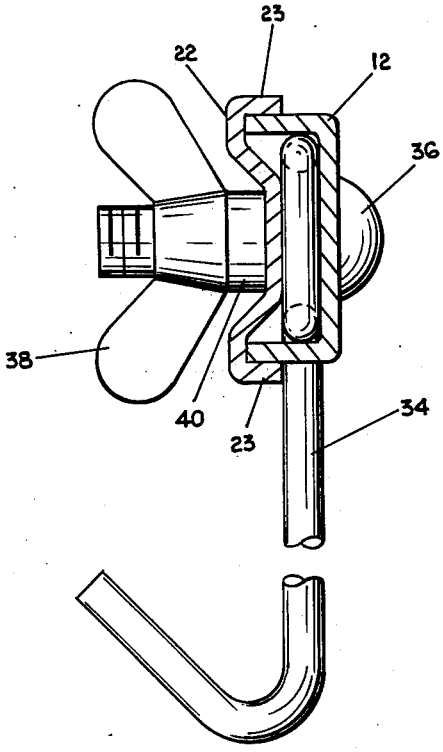
FIG. 9 is a cross-sectional view taken along line 9—9 as shown in FIG. 1 and showing the assembly of the horizontal arm, the hook, the inner channel member, the bolt, butterfly nut and spacer according to the invention.

Referring to FIG. 1, the adjustable rack has a vertical shaft 10 which is adjustably connected to a plurality of horizontal arms 12 holding a plurality of hooks 32 to enable objects to be supported therefrom. As shown in FIGS. 2, 3, and 9, the horizontal arm 12 is C-shaped in cross-section with the legs of the C forming the bottom and top sections and the bight section of the C being the side section with a plurality of square holes 28 through its bight section and a plurality of slots 34 extending through its bottom leg section. In the middle of the horizontal arm 12 is a larger square aperture 20 and at the ends of the upper and lower sections of the arm 12 are shallow notches 18 vertically aligned and vertically adjacent to the square aperture 20.

Figure 6:
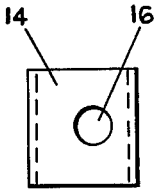
FIG. 6 is a front view of the clamp used to attach the horiztonal arm to the vertical shaft as shown in FIG. 3.
Figure 7:
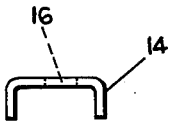
FIG. 7 is a top view of the clamp shown in FIG. 6.

As shown in FIG. 3, the vertical shaft 10 has a square cross-sectional area and which can fit within the shallow notch 18. A clamp 14 is then placed around the vertical shaft 10. The vertical clamp is shown in detail in FIGS. 6 and 7. The clamp 14 is C-shaped with an aperture 16 extending therethrough off-centered with respect to the clamp. When the clamp 14 is positioned over the square shaft 10 as shown in FIG. 3, the aperture 16 is aligned with aperture 20 to enable a bolt 24 to be inserted through the two apertures with a butterfly nut 26 tightened on the threaded end of the bolt 24 to hold in a fixed position the outer channel member 12 with respect to the vertical shaft 10. When desired, the butterfly nut 26 can be loosened and the horizontal arm 12 can be positioned up or down the vertical shaft 10 and retightened. When desirable, the horizontal arm 12 may be easily removed from the vertical shaft 10 by removing the butterfly nut 26, clamp 14 and bolt 24.

Figure 8:
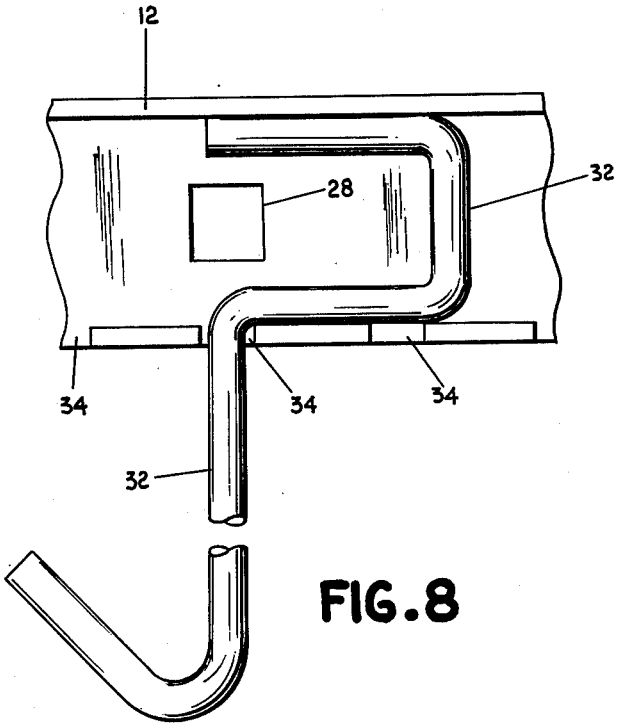
FIG. 8 is a partially broken and enlarged view showing the vertical hook's position within the horizontal arm.

As shown in FIG. 8, hooks 32 are placed through the slots 34 in the horizontal arm 12 and extend downwardly. The hooks 32 have an upper C-shaped section that enable the hook to have interlocking support from the C-shaped outer horizontal arm 12 and remain suspended.

Figure 5:
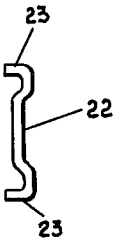
FIG. 5. is a side elevational view of the inner channel member.
Figure 10:
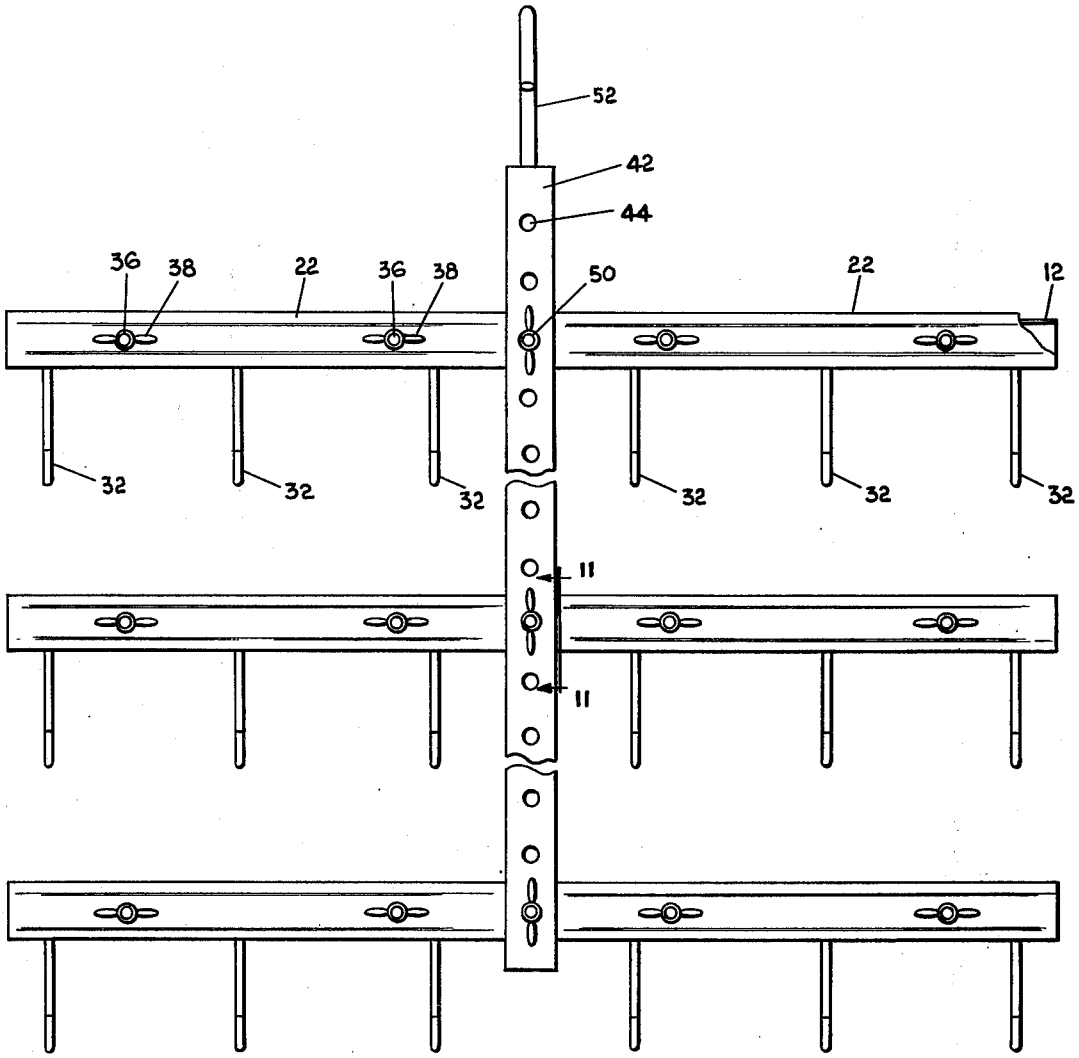
FIG. 10 is a front view of another embodiment of the invention.

An inner horizontal channel member 22, as shown in FIG. 9, is positioned at the open side of the C-shaped horizontal arm 12 and over the C-shaped portion of hooks 34. The inner horizontal channel member 22 has two circular apertures 30 that all aligned with two apertures 28 on each side of the outer horizontal channel member 12. As shown in FIG. 9, a bolt 36 extends through the apertures 28 and 30. A spacer 40 and a butterfly nut 38 are attached to the threaded end of the bolt 36. The nut 36 is tightened to secure and fix together the outer channel member 12, an inner horizontal channel member 22, and a plurality of hooks 32. The hooks 34 can be easily repositioned by removing the inner horizontal channel member 22 and moving the hooks 32 to different slots 34. If desired, a number of hooks may be removed. As shown in FIGS. 5 and 10, the inner channel member 22 has a lip 23 extending over the C-shaped horizontal arm 12 to help prevent paint and plating materials from clogging the horizontal channel where the hooks 34 may be positioned when spraying or plating the hanging objects.

Figure 11:
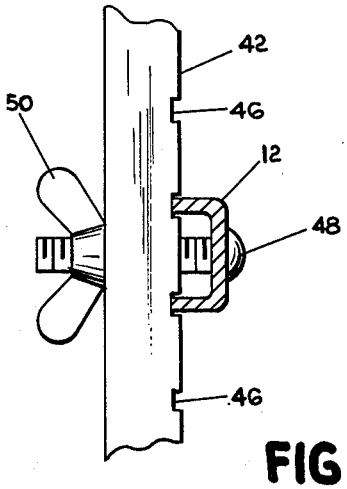
FIG. 11 is a partially broken view showing the means to attach the horizontal arm to the vertical shaft in the second embodiment of the invention.

FIGS. 10 and 11 show another embodiment of the invention. The outer horizontal channel member 12 is attached to a vertical shaft 42 which has a plurality of holes 44 extending therethrough. As shown in FIG. 11, horizontal slits 46 are formed in the vertical shaft on both sides of each hole 44. The C-shaped horizontal arm 12 fits in these slits 46 and is positioned so the aperture 20 in the horizontal arm 12 is aligned with the hole 44. A bolt 48 extends through the aperture 20 and hole 44 with a butterfly nut 50 threaded onto the bolt 48 and tightened to create a rigid support for the outer horizontal channel member 12.

The plurality of holes 44 positioned in the vertical shaft 42 provide vertical adjustability of the horizontal outer channel members. A number of horizontal arms 12 can be attached to the vertical shaft 42 at any of the holes 44. This provides for versatility when large or long objects are supported by the hooks 34. At the top of the vertical shaft 42, a hook 52 is welded on so as to provide a suitable means to attach to an overhead chain belt or conveyor.

It should be understood that the foregoing embodiments of the invention are merely illustrative of the preferred practice of the invnention and that various changes and modifications may be made in the arrangement and details of construction of the embodiments described herein without departing from the spirit and scope of the invention.

The embodiments of the invention in which an exclusive property or privilege is claimed are defined as follows:

1. An adjustable rack to hold objects that are to be plated or painted, said rack comprising:

a vertical support shaft;

a suspending means attached to the vertical shaft to support the rack from above;

at least one horizontal arm removably and adjustably attached to the vertical shaft;

fastening means removably connecting the horizontal arm to the vertical shaft to secure the horizontal arm in a fixed position with respect to the vertical shaft including a C-shaped clamp member, said C-shaped clamp member having an aperture disposed horizontally off-center with respect to the clamp member, said C-shaped clamp member receiving within the concave shape thereof, the vertical shaft, and a removable fastener extending through a hole in the horizontal arm and the aperture in the C-shaped clamp member to clamp the horizontal arm to the vertical shaft;

a plurality of hooks intervally spaced along the horizontal length of the horizontal arm, and a fastening means for removably and adjustably attaching the hooks vertically in a fixed position to the horizontal arm.

2. An adjustable rack as described in claim 1 wherein the vertical support shaft is a solid bar having means at its top for suspending the bar.

3. An adjustable rack as described in claim 1 wherein the horizontal arm has a notch in the side of the horizontal arm which abuts the vertical shaft to enable the vertical shaft to be disposed in the notch transversely to the horizontal arm.

4. An adjustable rack to hold objects that are to be plated or painted, said rack comprising:

a vertical support shaft;

a suspending means attached to the vertical shaft to support the rack from above;

at least one horizontal arm removably and adjustably attached to the vertical shaft wherein the horizontal arm is C-shaped in cross-section and has a plurality of deep notches extending from an edge of the bottom section toward the bight section of each C-shaped arm;

fastening means removably connecting the horizontal arm to the vertical shaft to secure the horizontal arm in a fixed position with respect to the vertical shaft;

a plurality of hooks intervally spaced along the horizontal length of the horizontal arm and positioned within the deep notches and having top sections fitting within the concave side of the C-shaped horizontal arm; and a fastening means for removably and adjustably attaching the hooks vertically in a fixed position to the horizontal arm.

5. An adjustable rack as described in claim 4 wherein: the fastening means attaching the plurality of hooks include an inner channel member positioned at the concave side of the horizontal arm and abutting the top section of the hooks, and removable fasteners clamping together the horizontal arm, the plurality of hooks and inner channel member.

6. An adjustable rack as described in claim 5 wherein: the horizontal arm has a plurality of apertures therethrough, the inner channel member has a plurality of apertures therethrough, and the removable fasteners extend through the apertures of the inner channel member and horizontal arm and clamp the horizontal arm, plurality of hooks and inner channel member.

7. An adjustable rack as described in claim 5 wherein the inner channel member has a lip at each horizontal edge that extends over the horizontal edges of the C-shaped horzontial arm so as to minimize spray paint or plating material from entering the channel through the concave side of the C-shaped horizontal arm.

8. An adjustable rack as described in claim 4 wherein the horizontal arm has vertically aligned shallow notches on the edges of the bottom and top sections, and the vertical shaft is disposed in the shallow notches transversely to the horizontal arm.

9. An adjustable rack as described in claim 4 wherein the vertical shaft has a plurality of holes therethrough and horizontal slits above and below each hole, the fastening means are removable fasteners which extend through the hole of the vertical shaft and a hole in the horizontal arm and which clamp the horizontal arm to the vertical shaft, and the horizontal arm engages the horizontal slits adjacent to the hole through which the horizontal arm is attached to the vertical shaft.

* * * * *